US005957457A

United States Patent [19]

Shaw

[11] Patent Number: 5,957,457

[45] Date of Patent: Sep. 28, 1999

[54] BINGO GAME FOR FACILITATING PRESENT OPENING

[76] Inventor: Eileen J. Shaw, P.O. Box 1075, North Marshfield, Mass. 02059

[21] Appl. No.: 09/016,674

[22] Filed: Jan. 30, 1998

Related U.S. Application Data

[60] Provisional application No. 60/034,882, Jan. 31, 1997.

[51] Int. Cl.[6] ..... A63F 3/06

[52] U.S. Cl. ..... 273/269

[58] Field of Search ..... 273/269, 139

[56] References Cited

U.S. PATENT DOCUMENTS

| | | | |
|---|---|---|---|
| D. 341,854 | 11/1993 | Mobley | D21/25 |
| 3,495,700 | 2/1970 | Chandos | 273/269 |
| 4,619,457 | 10/1986 | Small | 273/269 |
| 5,139,270 | 8/1992 | Gernhofer | 273/269 |
| 5,449,179 | 9/1995 | Hefferan | 273/269 |

FOREIGN PATENT DOCUMENTS

| | | | |
|---|---|---|---|
| 872703 | 7/1961 | United Kingdom | 273/269 |
| 1602510 | 11/1981 | United Kingdom | 273/269 |

OTHER PUBLICATIONS

Smith, Susanna Jun. 1994 Pending Trademark#74–543574.

*Primary Examiner*—Benjamin H. Layno
*Attorney, Agent, or Firm*—Sharon L. Day

[57] ABSTRACT

A Bingo-type game, a method of playing a Bingo-type game and a game board for playing such a game are provided. The Bingo-type game enhances the enjoyment of participants at a ceremony or party which, by social convention, requires the participants to observe while a guest-of-honor opens presents. The game board is provided with a series of shapes aligned in rows which form a matrix. Each shape has the name of a gift item likely to be opened imprinted thereon. The participants are each provided with a game board having a unique arrangement of the names of a determined list of gift items that are likely to be opened and a means of marking the game board. The names from the list of items are equal to the number of shapes in the matrix. When the guest-of-honor opens a present which corresponds to a name imprinted on a participant's game board, the participant marks it off. When all shapes in either a horizontal row or in a vertical row or in a corner-to-corner diagonal row have been marked, the participant declares "Bingo" and receives a reward.

8 Claims, 3 Drawing Sheets

BINGO GAME FOR FACILITATING PRESENT OPENING

This application claims priority from U.S. Provisional patent application Ser. No. 60/034,882, filed Jan. 31, 1997.

FIELD OF THE INVENTION

The invention is a bingo game for facilitating the enjoyment of a party by the participants while the guest of honor is opening presents.

BACKGROUND OF THE INVENTION

During certain ceremonies or parties at which a person is honored with gifts, the other participants in the ceremony or party are required by social convention to sit and watch while the gifts are opened. When the number of gifts is large, a participant may become disinterested in the gift opening and the time spent at the ceremony may become tedious for them, spoiling their enjoyment of the event. Various games have been devised to facilitate the enjoyment of the participants during other aspects of the ceremony or party, such as guessing games, sculpting chewing gum and the like, but none are available to increase the enjoyment of the participants during gift opening.

It is an object of the instant invention to provide a game which is simple to play and which facilitates a participant's enjoyment of the gift opening by the guest of honor, or the equivalent, at a ceremony or party.

III. SUMMARY OF THE INVENTION

A bingo game for playing at ceremonies or parties during gift opening by the guest of honor, or the equivalent, is provided. In a first embodiment where a single winner is desired, the game comprises a plurality of playing boards or cards, one for each participant wherein each board or card is distinct from that in the possession of any other participant at the ceremony or party, and a means of making marks on the individual participant's board or card. Each board has a face which is divided into a plurality of shapes, preferably a plurality of squares, however other shapes such as wedding bells and the like may be used. The shapes are aligned in horizontal, vertical and diagonal columns which form rows. Each shape is marked with the name of a gift which might be received at the type of ceremony or party at which the game is being played. In one embodiment for use at a bridal shower at which there are twenty five participants and the guest of honor, such as for example the bride-to-be, each of twenty five shapes on the board or card is imprinted with a unique name of a gift that the bride-to-be is likely to receive. Such gifts may include a blender, a toaster, a cookbook and the like. The names are randomized on the cards so that no two cards are exactly alike. As the bride-to-be opens each gift, the participants mark off the shape on their card that is printed with the name corresponding to the type of gift opened. The rules of the game can be altered to require an exact match of name in the shape to the exact gift such as for example when a knife is unwrapped the shape with the name "knife" is marked or the participant may be instructed to mark off a shape when a gift in a corresponding category is opened such as "utensil" when a knife is unwrapped. When one of the participants has marked five shapes in a row, independently of whether it is a vertical row, a horizontal row, or a diagonal row, the participant calls "Bingo" and receives a prize or other congratulatory reward.

In an alternate embodiment, the list of names of gifts to be used as indices on the game board is selected to match the occasion for the celebration, such as for example at a boy's birthday party. Such a list might include the names of various toys that the boy might receive. These names are marked on the game board in areas demarked by shapes appropriate to the occasion or in geometric shape. The shapes are arranged in a matrix in which the number of shapes in a row, be it horizontal, vertical, or diagonal, corner to corner of the matrix, is equal to the number of shapes in any other row. As the gifts are opened the participants are instructed to mark off a shape until a row has been marked off. Then, the participant is urged to state "Bingo". In other alternate embodiments the names of gifts can be selected from other lists appropriate to the occasion.

In each embodiment when multiple winners at a time are desired, only a percentage of the cards are distinct with respect to names of the gifts entered in each of the shapes. Further, the number of shapes per board or card can vary as long as each horizontal, vertical, and diagonal row has a number of shapes equal to any other row therein.

IV. BRIEF DESCRIPTION OF THE DRAWINGS

V. DESCRIPTION OF THE BEST MODE OF THE INVENTION

Figure 1:
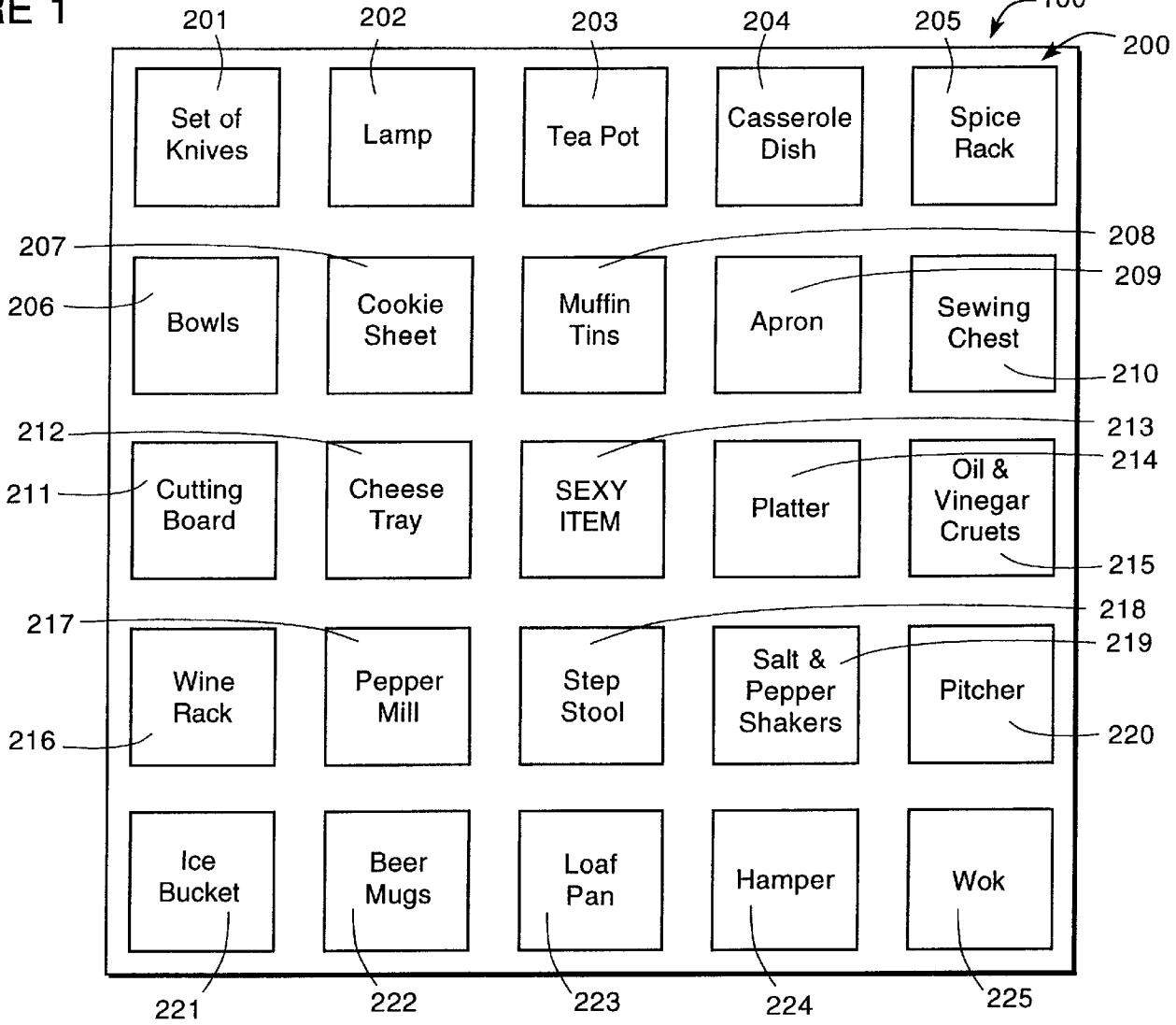
FIG. 1 illustrates a top perspective view of a first game board or card in a first set of game boards or cards according to one embodiment of the instant invention.

A plurality of boards or cards (each board generally referenced as 100, also termed a card, comprising a set of game boards provided. Each board in each set is provided with a plurality of shapes (each shape generally referenced as 200). Referring to FIG. 1 which shows a first board in a first set of game boards, each shape on the first board is a square 201–225. Each square has the name of a distinct gift item which might be received at the type of ceremony or party at which the game is to be played, such as in this example, a bridal shower. The first board of a set of twenty five boards for playing a game to enhance the enjoyment of participants at a ceremony or party at which gifts are opened by the guest of honor while the participants watch, has a first square 201 in the upper left hand corner of the board bearing the name of the gift item "Set of Knives" imprinted thereon. This square is a member of a first horizontal row, of a first vertical row and of a first diagonal row. The second square 202 in the first horizontal row has the name of the gift item "Lamp" imprinted thereon. The second square 202 is a member of the first horizontal row and is a member of the second vertical row , and so on the each subsequently named square. Continuing across the first horizontal row, square 203 has "Tea Pot", square 204 has "Casserole dish", and square 205 has "Spice Rack" imprinted thereon. Continuing with the second horizontal row, square 206 has "Bowls", square 207 has "Cookie Sheet", square 208 has "Muffin Tins", square 209 has "Apron" and square 210 has "Sewing Chest" imprinted thereon. In the third horizontal row, square 211 has "Cutting Board", square 212 has "Cheese Tray", square 213 has "Sexy Item", square 214 has "Platter", and square 215 has "Oil & Vinegar Cruets" imprinted thereon. In the fourth horizontal row, square 216 has "Wine Rack", square 217 has "Pepper Mill", square 218 has "Step Stool", square 219 has "Salt & Pepper Shakers", and square 220 has "Pitcher" imprinted thereon. In the fifth horizontal row, square 221 has "Ice Bucket", square 222 has "Beer Mugs", square 223 has "Loaf Pan", square 224 has "Hamper", and square 225 has "Wok" imprinted thereon.

Figure 2:
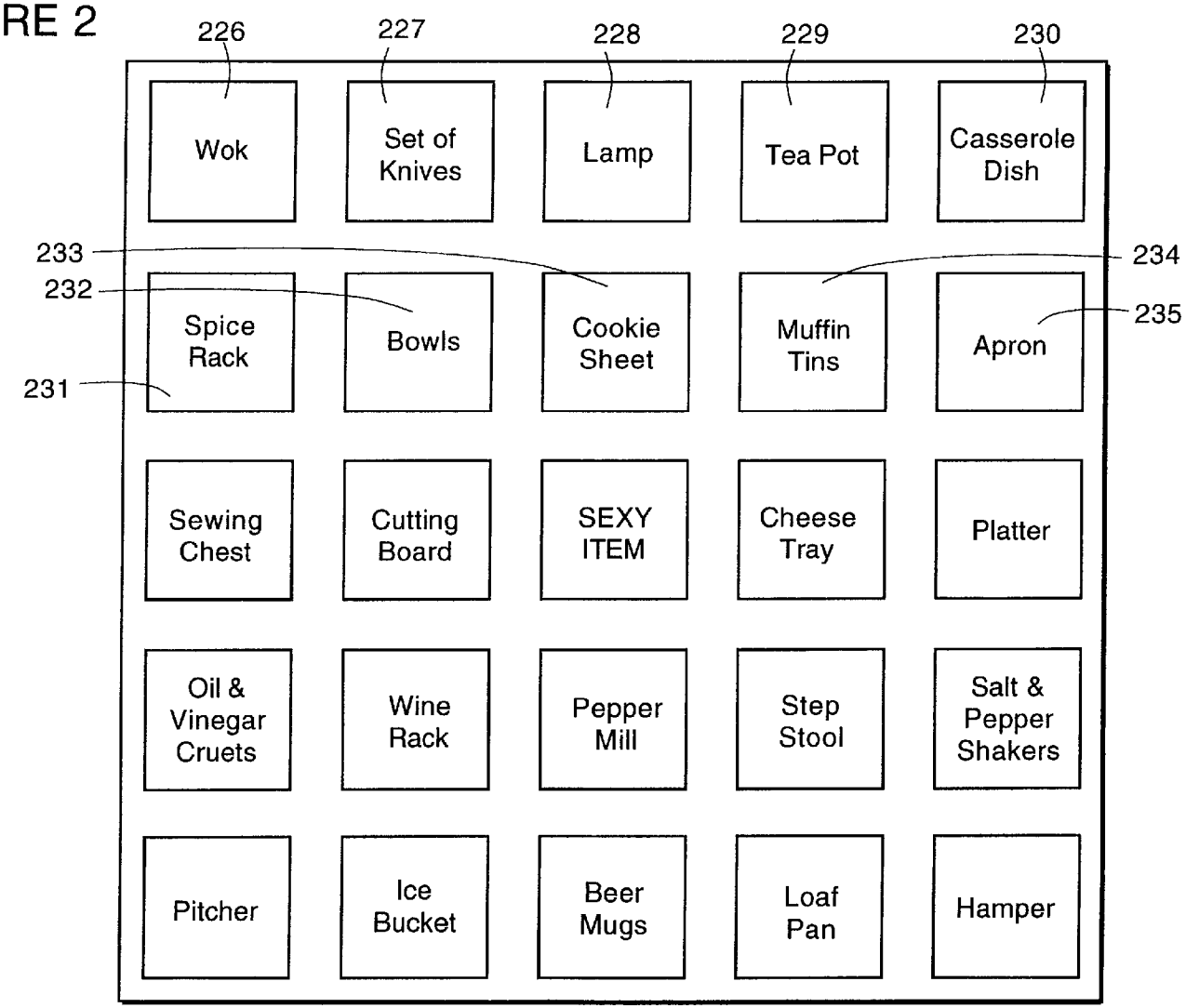
FIG. 2 illustrates a top perspective view of a second game board or card in a first set of game boards or cards according to one embodiment of the instant invention.

FIG. 2 illustrates a second board which is a member of the first set of game boards. Herein, it can be seen that the squares having the names of gifts imprinted thereon have been shifted to randomize the order in which the names of the gifts appear on this card, thereby rendering the second board distinct from the first game board of the set. As shown, the first square 226 in the upper left hand corner of the board bears the name of the gift item "Wok" imprinted thereon. Square 227 has the name of the gift item "Set of Knives" imprinted thereon. Continuing across the first horizontal row, square 228 has "Lamp", square 229 has "Tea Pot", and square 230 has "Casserole dish", imprinted thereon. Continuing with the second horizontal row, square 231 has "Spice Rack", square 232 has "Bowls", square 233 has "Cookie Sheet", square 234 has "Muffin Tins", square 235 has "Apron" imprinted thereon, and so on. The randomization having been achieved by shifting the bottom right hand most name of a gift item imprinted in a square to the square at the top upper left most corner and shifting the names of the gift items in each square in a serpentine pattern. However, it is contemplated that any means of randomization of the names of the gift items that gives rise to a set of cards or boards wherein each card or board is distinct from each other card or board in the set can be utilized. Further, some cards or boards may have one or more names of gift items which do not appear on other boards. For example, on one or more boards, the gift item "Muffin Tin" may be replaced by the gift item "Pie Plate". For example, names of gift items, include "Nightie", "Slippers", "Goblets", and so forth. The names of the gift items may be in any language, such as for example, all the gift item names may be in Spanish or in Chinese.

Figure 3:
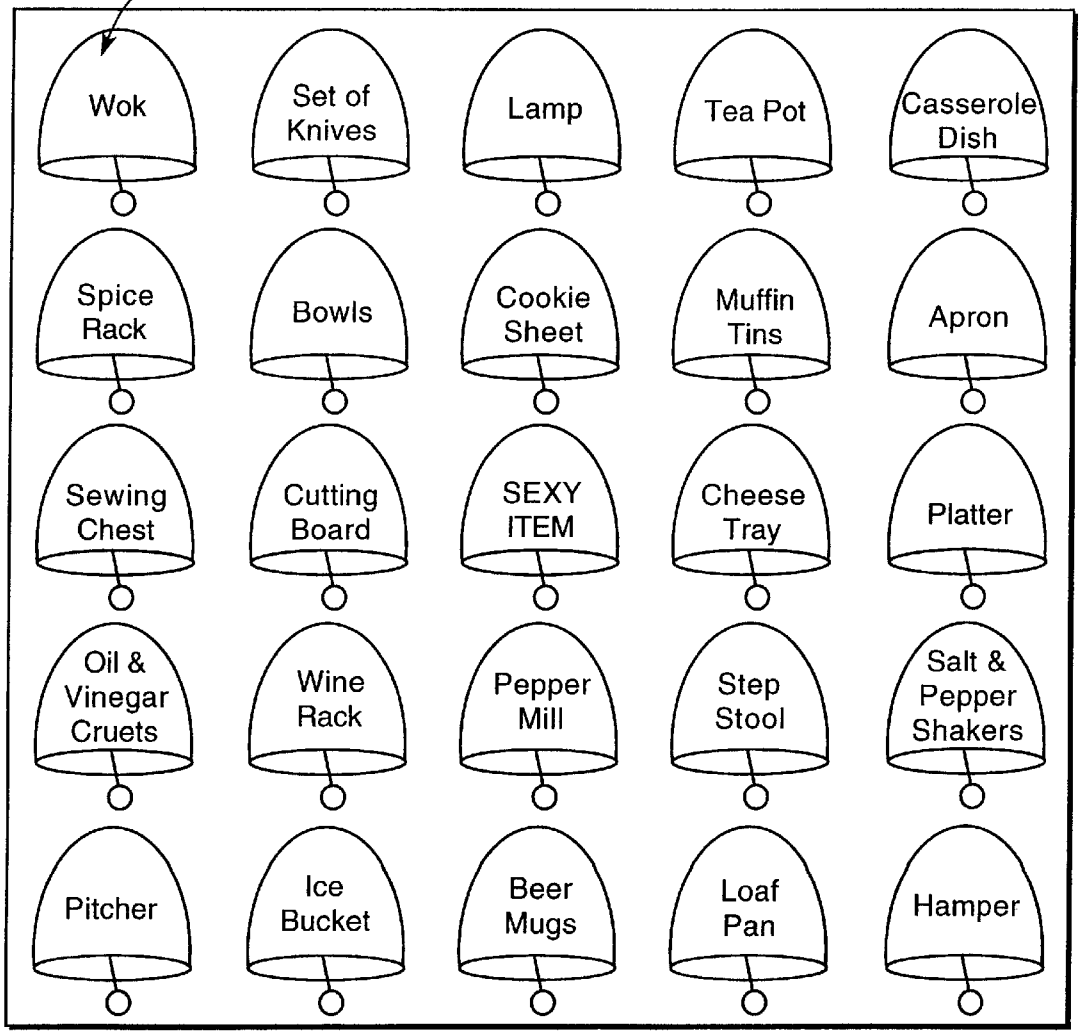
FIG. 3 illustrates a top perspective view of a first game board or card in a first set of game boards or cards according to an alternate embodiment of the instant invention.

Referring now to FIG. 3 which illustrates a top perspective view of a game board or card wherein a symbol is used to designate a shape which is associated with the occasion being celebrated The shape which is used to define rows which form a matrix is one of a bell 301 such as might represent a wedding bell. Such a game board may be used at a bridal-shower party. As above where the shape is illustrated as a square, the names of gift items are printed on the bells, one gift item name per bell. Each bell has a different gift item named therein. The game boards in a set are each distinct from one another with regard to order in which the gift items appear in rows.

Preferably, the game board is generally rectangular in shape in the set of game boards. A blank header for receiving an inscription may be provided. Each board is provided with a plurality of imprints of a single shape and is not considered to be limited to a particular number of imprints of a shape. The plurality of imprints of a shape is arranged in a rectangular matrix having discrete rows. These row are horizontally, vertically, and diagonally arranged on the game card or board. The imprints of a shape comprising the matrix are of any desired single shape. A mixture of shapes is contemplated on a single board. Imprints of shapes may be added or subtracted as long as each board has an equal number of imprints per row arranged in the matrix pattern. Thus, each row of imprints of shapes on a game board in a set of game boards to be used in any one game, be the row a horizontal or a vertical or a corner-to-corner diagonal row, is equal in number to any other board in that set of game boards. However, each set of game boards may have game boards having a matrix comprised of a different number of shapes. For example, if the number of guests at the party is four, the matrix may have nine imprints of shapes arranged in rows. If the number of guests is twenty-four, the number of imprints of a shape may be twenty five. The size of the board is not considered to be limited nor is the shape of the board. The game board shape may also be altered to suit the type of ceremony or party at which the game is to be played as long as the imprints thereon form a regular matrix comprised of discrete rows. Only the parameters relating to the matrix of shapes with names of gifts printed on the face of the board are necessarily fixed.

Generally, the boards have squares with the names of gifts arranged in rows. However, imprints of geometric shapes for use on the game board other than squares or rectangles are also contemplated. Different shapes representing symbols associated with the type of party being given are contemplated. For example, such symbols could include overlapping rings, a wedding cake shape, or a bride and groom if the occasion where a bridal shower. Or for example, if the game is to be played at a retirement party, the imprint of the shape of a Champaign glass may be used in place of a square, or a rattle shape may be used when the game is to be played at a baby shower. The names of the gift items likely to be received would then also be adjusted to be suitable for the occasion. Preferably, the set of named gift items equals the number of imprints of shapes in the matrix. Preferably, each named gift item of the set is randomly assigned to an imprint of a shape so that no two boards are exactly identical in the placement of the names of gift items.

The set of named gift items, also referred to as a list of gifts, varies depending upon the type of ceremony or party. FIGS. 1–3 illustrate game boards that are useful at bridal showers. However, other sets or lists of gift items can be used which are appropriate to the occasion being celebrated. Such as for example at a boy's birthday party, the list may include the items "truck", "car", "building blocks," "boat," "roller blades," "baseball," "bat," and so on. These names of items would then be randomly arranged on a game board having a shape printed therein in a matrix of like shapes and then re-arranged on other game boards to form a set. Alternatively, the shape itself represents the gift and no names in the shapes are required. Thus, each game board has a plurality of different shapes arranged in a matrix and the arrangement of the shapes varies for game board to game board. This is particularly useful at celebrations were the participants do not read.

The game cards or boards preferably are made of a heavy weight paper. However, any material which can receive and hold a mark may be used. The type of marker used is determined by the game board material. For example, when the board is composed of paper, a pen, a pencil, a crayon, or some form of sticker is used to mark the items off as the item is opened. Alternatively, if the board is slate or slate-like, chalk or stickers are used. Multiple possible combinations of board type and marker can be used.

An example of a method for playing the game at a bridal shower is as follows: (this portion of the description has been copyright protected)

1.) Provide each guest with a distinct game card imprinted with squares bearing the names of gift items likely to be given at a bridal shower and a suitable marker for the card.
2.) Instruct each guest to mark off any gift shown on their game card as the bride-to-be opens the gift.
3.) Have the first guest to mark all the squares in either a horizontal or a vertical or a corner-to-corner diagonal row, announce "Bingo!"

4.) Provide the guest who announced "Bingo" with a prize, such as for example, a sachet, perfume, stationary and the like or declare that guest a "winner".

An alternative method of playing the game is to provide the participants with game boards having a category of a gift likely to be opened is printed in the shape. In this variation, the participants are instructed to mark off a shape when a gift in a corresponding category is opened such as for example "utensil" when a knife is unwrapped. The game proceeds as above while using the alternative game board.

Alternatively, different lists of gifts likely to be opened at a party or ceremony are used to produce different sets of game boards, then the sets are randomized among the participants. Where a first list of names of gift items is used to label the shapes on the board and this list is randomized on the shapes to provide a set of different cards, a first game set is created. Then a second list is used and a second game set is created. Boards from more than one game set can be distributed to the participants, one board per participant. In this circumstance, a greater number of possible gifts are named, increasing the chance that the gift opened will result in at least one participant marking a shape on a board.

Modifications and variations can be made to the disclosed embodiments without departing from the subject and spirit of the invention as defined in the following claims. Such modifications and variations , as included within the scope of these claims, are meant to be considered part of the invention as described.

What is claimed is:

1. A bingo-type game for enhancing the enjoyment of each of a plurality of participants at a ceremony or party at which at least some gift items are present, said gift items each having a concealing means thereon and at which a guest of honor removes said concealing means to provide at least some revealed gifts while said participants watch, said bingo-type game comprising:

a board;

a plurality of shapes, each shape aligned in a horizontal row and in a vertical row on said board; and a plurality of imprinted names of gift items, each imprinted name of said gift item locate within one of said shapes, each imprinted name differing from an other said imprinted name present on said board, at least some of said plurality of imprinted names corresponding to said revealed gifts.

2. The Bingo-type game of claim 1 wherein said plurality of imprinted names of gift items are Spanish names.

3. The Bingo-type game of claim 1 further comprising a means of marking said game board.

4. The bingo-type game of claim 1 wherein each of said plurality of shapes is geometrically different from an other of said plurality of shapes.

5. A method for playing a bingo-type game at a party or ceremony for enhancing the enjoyment of a participant during said party or ceremony when the guest of honor is opening a gift, said bingo-type game comprising the following steps:

providing a plurality of gift items;

providing said participant with a game board imprinted with a plurality of names of gift items, each name imprinted in a shape, each shape aligned in a vertical row and in a horizontal row on said game board at least some of said names corresponding to said plurality of gift items;

providing a concealing means for individually covering each of said gift items from view;

providing said participant with a means of making marks on said game board;

instructing said guest of honor to remove said concealing means thereby providing a revealed gift item;

instructing said participant to mark off said name of said gift item on said board, when said name corresponds to said revealed gift item, said guest of honor continuing to remove said concealing means from other gift items providing additional revealed gift items until said participant has completely marked off all said names of said gift items in said vertical row, in said horizontal row or in a corner-to-corner diagonal row; and instructing said participant to vocalize "Bingo" when all of said names of gift items in one of said vertical row, said horizontal row, or said corner-to-corner diagonal row have been marked off.

6. The Bingo-type game of claim 1 wherein said shape is a rectangle.

7. The Bingo-type game of claim 6 wherein said game board has a non-rectangular shape.

8. The Bingo-type game of claim 1 wherein said shape is a symbol.

* * * * *